United States Patent [19]

Dollar et al.

[11] 3,972,743

[45] Aug. 3, 1976

[54] HIGH STRENGTH, STABLE ZINC-ALUMINUM ALLOY

[75] Inventors: David L. Dollar; Raymond E. Giuliani; Michael J. Mirra; Jon W. Headrick, all of Greeneville, Tenn.

[73] Assignee: Ball Corporation, Muncie, Ind.

[22] Filed: Oct. 20, 1975

[21] Appl. No.: 623,709

[52] U.S. Cl. ..... 148/11.5 R; 148/32

[51] Int. Cl.[2] ..... C22C 18/04; C22F 1/16

[58] Field of Search ..... 148/11.5 R, 32; 75/178 AM

[56] References Cited

UNITED STATES PATENTS

| | | | |
|---|---|---|---|
| 2,169,441 | 8/1939 | Winter et al. | 148/11.5 R |
| 3,420,717 | 1/1969 | Fields, Jr. et al. | 148/11.5 R |
| 3,741,819 | 6/1973 | Chollet et al. | 148/11.5 R |
| 3,753,791 | 8/1973 | Swanson | 148/11.5 R |
| 3,793,091 | 2/1974 | Gervais et al. | 148/11.5 R |
| 3,843,416 | 10/1974 | Cross et al. | 148/11.5 R |

*Primary Examiner*—W. Stallard
*Attorney, Agent, or Firm*—Gilbert E. Alberding

[57] ABSTRACT

This invention relates to a stable zinc-aluminum quaternary alloy having tensile strength well in excess of 50,000 psi and excellent machinability characteristics, the alloy being formed by subjecting the zinc-aluminum alloy containing from about 20 to 28 weight percent aluminum, from about 0.1 to 3.5 weight percent copper, about 0.01 to 0.5 weight percent magnesium and the remainder zinc, at a temperature between about 550°F., and 750°F., for a time to effect homogenization of said alloy, working the homogenized alloy at a temperature above the eutectoid transformation temperature, quenching the alloy, providing an effective temperature for a period of time to produce transformation into a two-phase alloy and cooling the alloy to ambient temperature.

15 Claims, 1 Drawing Figure

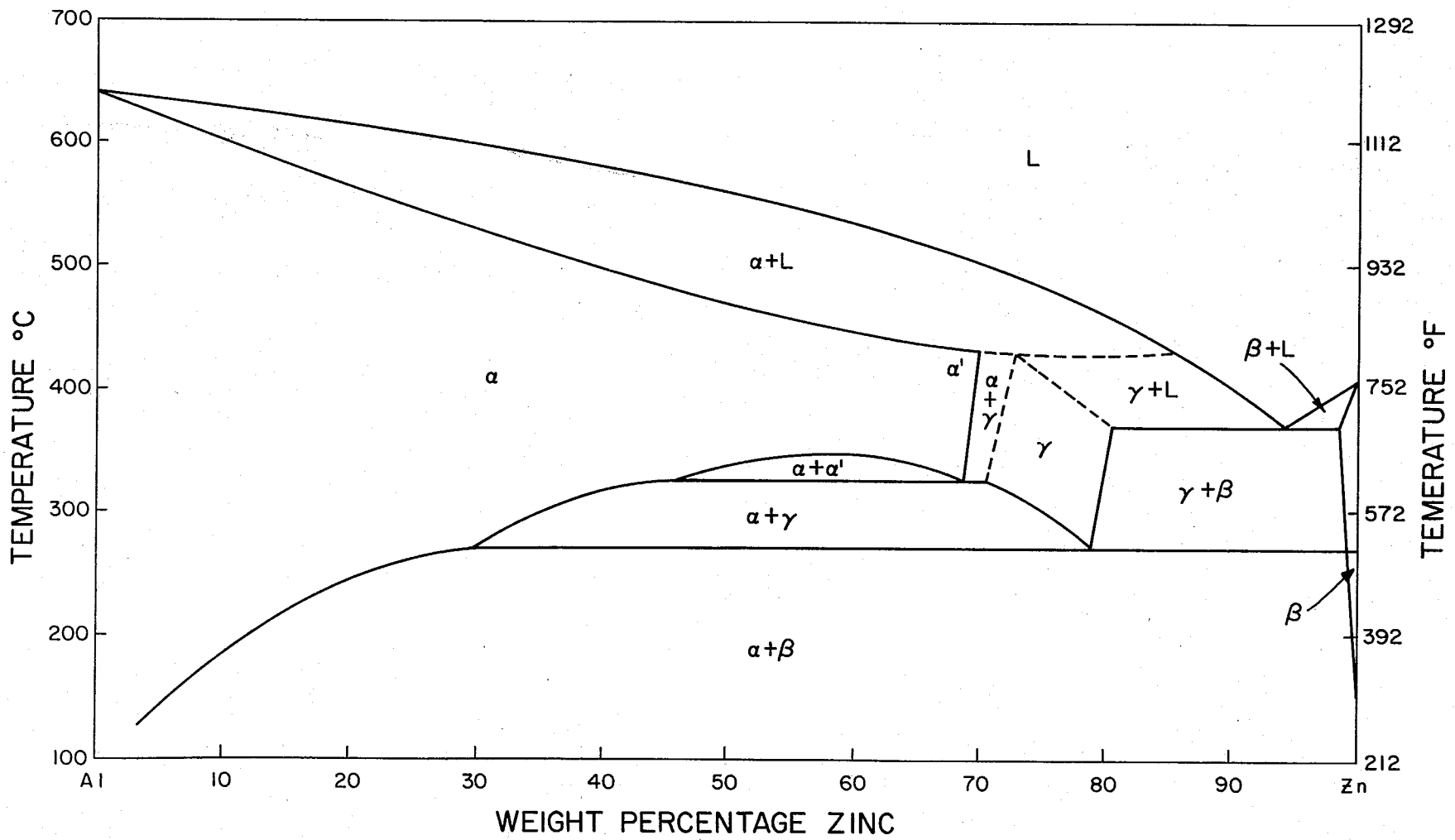
TEMPERATURE °F
1292
1112
932
752
572
392
212
TEMPERATURE °C
700
600
500
400
300
200
100
Al
Zn
10
20
30
40
50
60
70
80
90
WEIGHT PERCENTAGE ZINC
L
β+L
β
γ+β
γ+L
γ
α+γ'
α'
α+α'
α+γ
α+β
α+L
α

HIGH STRENGTH, STABLE ZINC-ALUMINUM ALLOY

BACKGROUND OF THE INVENTION

1. Field of the Invention

This invention relates to improvements in alloys having enhanced mechanical characteristics, and is particularly pertinent to substitutes of alloys, especially of the Cu/Zn type and the like. Furthermore, the subject invention relates to improved zinc-aluminum quaternary alloys and is particularly directed to methods of providing such alloys as stock material with excellent tensile strength.

2. Description of Prior Art

Zinc and various alloys thereof have generally been regarded as metals having mechanical properties that render them commercially unsuitable for wide structural usage. For an example, such metals normally have low tensile strength and poor resistance to deformation at relatively low stress levels even at ambient temperature. Formed articles when subjected to stresses at ambient temperatures, accordingly have not heretofore been made for structural application mainly due to these poor characteristics.

A number of compositions comprised of zinc alloyed with various elements are known by the prior art to have been fabricated to achieve certain end products. A general review of the relevant patents in this art is in order.

Winter, et al., U.S. Pat. No. 2,169,441 disclose that the working of an aluminum-bearing zinc base alloy containing from 10 to 20% aluminum at a temperature ranging from 518° F., to 716° F., improve the machinability, tensile strength and impact strength of said alloy. Generally, the relatively high copper content (Cu 1.5 to 4 percent) of this alloy and the disclosed thermal treatment do not permit production of a product with the high ultimate tensile strength that can be obtained by the method of the present invention.

Pelzel U.S. Pat. No. 2,982,677 discloses a method of manufacturing bearing alloys by heat treating Zn/Al/Cu alloys having at least 2.2% copper and less than 0.01%, preferable less than 0.005%, magnesium. Alloys produced by Pelzel have improved bearing properties but inferior mechanical properties to the present invention.

Hare, et al., U.S. Pat. No. 3,676,115 disclose an alloy comprising zinc within the range 70–82 weight percent, aluminum in the range of 18–30 weight percent, magnesium within the range from 0.05 to 0.25 weight percent and up to 2 weight percent of one or more of the elements copper, nickel and silver. The zinc alloys have exhibited ultimate tensile strengths of about 52,000 psi.

Chollet, et al., U.S. Pat. No. 3,741,819 relate to an alloy consisting essentially of 18–30% aluminum, up to 3% copper, up to 0.10% magnesium, up to 0.10% lithium and the balance zinc. The patent discloses a method of heat treating alloys to enhanced properties thereof by slow cooling the alloy from between about 380° C., and about 290° C. The alloy produced has a tensile strength of 43,600 psi.

Gervais, et al., U.S. Pat. No. 3,793,091 disclose ternary and quaternary zinc-aluminum alloys which are conditioned to exhibit superplastic behavior by hot working thereof at temperatures between about 205° C. and the eutectoid temperatures of the alloy. In particular, the alloy of Gervais, et al., is produced by a rapid ice water quenching method followed by hot working.

Gervais, et al., U.S. Pat. No. 3,862,863 disclose a heat treatment for wrought zinc-aluminum alloys employing a two-stage cooling process. The first stage is the slow cooling of the alloy from above its eutectoid temperature, generally requiring an average rate of cooling less than about 3.0° C., per minute followed immediately by a rapid-cooling step to ambient temperature.

SUMMARY OF THE INVENTION

The alloys investigated in the present invention are the quaternary alloys comprising zinc, aluminum, magnesium and copper. The alloys when treated in accordance with this invention render highly stable alloys having enhanced mechanical properties, with ultimate tensile strengths well in excess of 50,000 psi while maintaining reasonable ductility.

In accordance with the instant invention, a stable, metallurgical composition is disclosed having from about 20 to 28 weight percent aluminum, from about 0.1 to about 3.5 weight percent copper, about 0.01 to 0.5 weight percent magnesium and the remainder zinc. Further, in accordance with the invention a method of manufacturing the stable, metallurgical composition is disclosed, the method comprising subjecting a zinc-aluminum quaternary alloy as disclosed herein to a temperature between about 550° F., to about 750° F., to effect homogenization of the alloy, working the homogenized alloy at a temperature above its eutectoid transformation temperature, quenching the worked alloy, providing an effective temperature for a period of time to produce transformation into a two-phase alloy, and cooling the transformed two-phase alloy to ambient temperature. The alloy itself has a fine grained lamellar microstructure consisting of an alpha-phase of aluminum rich material and a beta-phase of zinc rich material.

It is the main object of the instant invention to provide a method of producing novel homogeneous zinc aluminum quaternary alloys for shaping and forming various articles which exhibit enhanced mechanical properties including increased ultimate tensile strengths and hardness over other zinc based alloys presently being produced without loss of ductility.

Another essential object of the subject invention is to provide an alloy composition having a wide stability over extended periods of time without any significant loss in ultimate tensile strength.

Another object of the instant invention is to provide a novel homogeneous alloy composition as a most advantageous substitute for conventional copper-zinc alloys including brass and also for aluminum alloy compositions.

These and other objects of the instant invention will become more readily apparent from the following detailed description.

Alloying may be readily accomplished in a conventional induction furnace which provides thorough mixing of the alloy ingredients to form the melt. Casting may be accomplished by any number of conventional techniques. The nature of the subject alloy composition is such that its cast structure is dendritic and, therefore, a homogenization treatment is necessary to obtain the desired two-phase lamellar microstructure.

The term "homogenization" means the production of a homogeneous alloy quality characterized by a uniform dispersion of the alpha and beta phases.

In commercial practice, homogenization may be readily accomplished by heating the alloy between the temperatures of about 550° F., to about 750° F., for an appropriate length of time. A preferred homogenization treatment for the subject alloy composition is one of heating the alloy to a temperature between about 630° F., to about 670° F., for a period of about six hours.

The working of the alloy may be accomplished by a number of means known to those skilled in the art. In general, working of the homogenized alloy is readily accomplished at a temperature above the eutectoid transformation temperature and is accomplished by passing the alloy through rolls such that there is from between about 10 to 70 percent reduction in thickness of the alloy strip. The homogenized alloy may be readily worked through other means including extrusion, forging, rolling, swagging and the like. The worked alloy must then be quenched to a temperature below about 400° F. This is readily accomplished by numerous methods known to those skilled in the art.

The quench temperature is generally between about 300° to 400° F. In general, the quench temperature is held for a minimum of about at least 10 minutes prior to cooling the alloy to ambient temperature. It has been determined that a holding time, at the quench temperature, is required to produce an effective transformation of the gamma-phase alloy into the lamellar two-phase alpha, aluminum-zinc plus beta, zinc-aluminum alloy.

The final cooling of the alloy may be readily accomplished by means known to those skilled in the art. Cooling of the subject alloy from the quench temperature to ambient temperature must be accomplished at a controlled rate. Said cooling rate is dependent on the final mechanical property requirements.

In the accompanying drawing the binary zinc-aluminum phase diagram is illustrated. For simplicity, the diagram does not take into consideration the effect of the copper and magnesium alloying components. Of course, with those elements in the binary, the temperature boundaries may be slightly modified. The compositions herein may be generally considered as being on the aluminum side of the eutectic point that represents about 95 weight percent zinc and about the 5 weight percent aluminum eutectic composition in the zinc-aluminum phase diagram.

Although the composition of the quaternary may vary over a wide range, the preferred range to achieve the desired results herein contemplated are especially defined. A range of about 20 to about 28 weight percent aluminum, a range of about 0.1 to about 3.5 weight percent copper, and a range of about 0.01 to about 0.5 weight percent magnesium is preferred. Greater alloying concentrations result in very brittle material having poor formability. Lower alloying concentrations result in inferior strength, mechanical property stability with respect to time and poorer corrosion resistance.

For the purpose of giving those skilled in the art a better understanding of the invention, as well as a better appreciation of the advantages of the invention, the following examples of the invention are given by way of illustration.

EXAMPLE I

An alloy having the following composition was made:

| | |
|---|---|
| Aluminum | 25.0 weight percent |
| Copper | 1.01 weight percent |
| Magnesium | 0.031 weight percent |
| Zinc | Remaining weight percent |

The alloy was cast with a metal temperature of about 980° F., and processed to a thickness of about 0.25 inches. The worked alloy was thereafter placed in a 650° F., oven for 16 hours to effect homogenization. The homogenized alloy was thereafter fan cooled to about 550° F., and thereafter passed through a 4-Hi Mill to achieve about 57 percent reduction, i.e., from about 0.25 inches to about 0.108 inches, the mill having an entrance temperature of about 550° F., and an exit temperature reduced to about 350° F., at about 200° F., per second, by quenching via a liquid coolant spray on the exit side of the 4-Hi Mill. The alloy was thereafter allowed to remain at temperature for between about 10 to about 15 minutes. The thus-treated alloy was then fan cooled to about 200° F., at about 67° F., per hour, then allowed to air cool to room temperature.

The resulting alloy had an ultimate tensile strength of about 70,500 psi, an elongation of about 12%, and a hardness of about 76 $R_B$ (Rockwell, B-scale).

EXAMPLE II

An alloy having the following composition was made:

| | |
|---|---|
| Aluminum | 25.0 weight percent |
| Copper | 1.0 weight percent |
| Magnesium | 0.031 weight percent |
| Zinc | Remaining weight percent |

The alloy was cast with a metal temperature of about 980° F., and processed to a thickness of about 0.25 inches. The worked alloy was thereafter placed in a 650° F., oven for about 16 hours to effect homogenization. The homogenized alloy was thereafter air cooled to about 350° F., and thereafter rolled on a 4-Hi Mill to effect a total reduction of about 57 percent with both the entrance and exit temperatures of the rolling mill at about 325° F. The alloy was thereafter allowed to remain at temperature for between about 10 to about 15 minutes. The rolled alloy was thereafter allowed to air cool to room temperature.

The resulting alloy had an ultimate tensile strength of about 51,000 psi, an elongation of about 30%, and a hardness of about 50 $R_B$.

EXAMPLE III

An alloy having the following composition was made:

| | |
|---|---|
| Aluminum | 25.0 weight percent |
| Copper | 1.0 weight percent |
| Magnesium | 0.030 weight percent |
| Zinc | Remaining weight percent |

The alloy was cast with a metal temperature of about 972° F., and processed to a thickness of about 0.175 inches. The worked alloy was thereafter placed in a 650° F., oven for about 16 hours to effect homogenization. The homogenized alloy was then removed from the oven and fan cooled to a temperature of about 550° F., and thereafter passed through a 4-Hi Mill to achieve a reduction of about 38percent, i.e., from about 0.175 inches to about 0.108 inches, the mill having an entrance temperature of about 550° F., and the exit temperature reduced to about 350° F., at about 200° F., per second by quenching via a liquid coolant spray on the exit side of the 4-Hi Mill. The alloy was thereafter allowed to remain at temperature for between about 10 to about 15 minutes. The thus-treated alloy was then fan cooled to about 200° F., at about 67° F., per hour and then allowed to air cool to room temperature.

The resulting alloy had an ultimate tensile strength of about 72,000 psi, an elongation of about 10%, and a hardness of about 80 $R_B$.

EXAMPLE IV

An alloy having the following composition was made:

| | |
|---|---|
| Aluminum | 25.0 weight percent |
| Copper | 1.0 weight percent |
| Magnesium | 0.03 weight percent |
| Zinc | Remaining weight percent |

The alloy was cast with a metal temperature of about 970° F., and processed to a thickness of about 0.250 inches. The worked alloy was thereafter placed in a 650° F., oven for about 16 hours to effect homogenization. The homogenized alloy was thereafter fan cooled to about 550° F., and thereafter passed through a 4-Hi Mill to achieve an initial reduction of about 30 percent, i.e., from about 0.250 inches to about 0.175 inches, the mill having an entrance temperature of about 550° F., and the exit temperature being reduced to about 350° F., at about 200° F., per second by quenching via a liquid coolant spray on the exit side of the 4-Hi Mill. The alloy was thereafter given a second rolling pass with a reduction of about 38percent, i.e., from about 0.175 inches to about 0.108 inches, the mill having an entrance temperature of about 350°F., and the exit temperature reduced to 220° F., at about 65° F., per second by quenching via a liquid coolant spray on the exit side of the 4-Hi Mill. The alloy was thereafter allowed to remain at temperature for between about 10 to about 15 minutes. The alloy was thereafter fan cooled to about 200° F., and thereafter allowed to air cool to room temperature.

The thus-treated alloy had an ultimate tensile strength of about 63,000 psi, an elongation of about 25 percent and a hardness of about 66 $R_B$.

EXAMPLE V

An alloy having the following composition was made:

| | |
|---|---|
| Aluminum | 25.0 weight percent |
| Copper | 1.0 weight percent |
| Magnesium | 0.029 weight percent |
| Zinc | Remaining weight percent |

The alloy was cast with a metal temperature of about 980° F., and processed to a thickness of about 0.108 inches. The worked alloy was thereafter placed in a 650° F., oven for about 16 hours to effect homogenization. The homogenized alloy was thereafter removed from the oven and fan cooled to a temperature of about 550° F., and thereafter passed through a 4-Hi Mill to achieve a reduction of about 31 percent i.e., from about 0.108 inches to about 0.074 inches, the mill having an entrance temperature of about 550° F., and the exit temperature reduced to about 280° F., at about 275° F., per second by quenching via a liquid coolant spray on the exit side of the 4-Hi Mill. The alloy was thereafter allowed to remain at temperature for between about 10 to about 15 minutes. The alloy was thereafter fan cooled to about 200° F., and thereafter allowed to air cool to room temperature.

The thus-treated alloy had an ultimate tensile strength of about 70,000 psi, an elongation of about 10 percent, and a hardness of about 78 $R_B$.

EXAMPLE VI

An alloy having the following composition was made:

| | |
|---|---|
| Aluminum | 25.0 weight percent |
| Copper | 1.01 weight percent |
| Magnesium | 0.031 weight percent |
| Zinc | Remaining weight percent |

The alloy was cast with a metal temperature of about 975° F., and processed to a thickness of about 0.250 inches. The worked alloy was thereafter placed in a 650° F., oven for about 16 hours to effect homogenization. The homogenized alloy was thereafter removed from the oven and fan cooled to about 550°F., and thereafter passed through a 4-Hi Mill to achieve a reduction of about 70 percent, i.e., from about 0.250 inches to about 0.074 inches, the mill having an entrance temperature of about 550° F., and the exit temperature reduced to about 300° F., at about 350° F., per second by quenching via a liquid coolant spray on the exit side of the mill. The alloy was thereafter allowed to remain at temperature for between about 10 to about 15 minutes. The alloy was thereafter fan cooled at about 100° F., per hour to a temperature of about 200° F., and thereafter allowed to air cool to room temperature.

The thus-treated alloy had an ultimate tensile strength of about 68,000 psi, an elongation of about 12% and a hardness of about 74 $R_B$.

EXAMPLE VII

An alloy having the following composition was made:

| | |
|---|---|
| Aluminum | 25.0 weight percent |
| Copper | 1.0 weight percent |
| Magnesium | 0.029 weight percent |
| Zinc | Remaining weight percent |

The alloy was cast with a metal temperature of about 970° F., and processed to a thickness of about 0.250 inches. The worked alloy was thereafter placed in a 650° F., oven for about 16 hours to effect homogenization. The homogenized alloy was thereafter removed from the oven and fan cooled to about 550° F., and thereafter passed through a 4-Hi Mill to achieve a reduction of about 70 percent, i.e., from about 0.250 inches to about 0.074 inches, the mill having an entrance temperature of about 550° F., and the exit temperature reduced to about 280° F., at about 180° F., per second by quenching via a liquid coolant spray on the exit side of the mill. The alloy was thereafter allowed to remain at temperature for about 15 minutes. The alloy was thereafter cooled to a temperature of about 200° F., at about 17° F., per minute via a water spray. The alloy was thereafter allowed to air cool to room temperature.

The thus-treated alloy had an ultimate tensile strength of about 72,000 psi, an elongation of about 12 percent, and a hardness of about 77 $R_B$.

We claim:

1. Method of manufacturing a stable, two-phase, high strength alloy, having enhanced mechanical properties, having a high tensile strength which comprises:

subjecting a Zn/Al/Cu/Mg alloy containing from about 20 to 28 weight percent aluminum, from about 0.1 to 3.5 weight percent copper, about 0.01 to 0.5 weight percent magnesium, and the remainder zinc, to a temperature and for a time to effect homogenization of said alloy, working the homogenized alloy at a temperature above the eutectoid transformation temperature to attain between about 10 to 75 percent reduction, quenching the worked alloy, providing an effective temperature for a period of time to produce transformation into a two-phase alloy, and cooling the transformed two-phase alloy to ambient temperature.

2. The method in accordance with claim 1 wherein the homogenization of the alloy is carried out between a temperature of 550° F., to about 750° F.

3. The method in accordance with claim 1 wherein the temperature to effect homogenization is 650° F., ± 20°F.

4. A method in accordance with claim 1 wherein the working is carried out by rolling the homogenized alloy.

5. A method in accordance with claim 1 wherein the quenching of the worked alloy is made to a temperature below about 400° F.

6. A method in accordance with claim 1 wherein the quenching of the rolled alloy is to a temperature of about 350° F.

7. A method in accordance with claim 1 wherein the quenching of the rolled alloy is to a temperature of about 300° F.

8. A method in accordance with claim 1 wherein the temperature is maintained at about 300° F., to about 400° F., for a period of at least 10 minutes to effect transformation.

9. A method of manufacturing a stable, two-phase, high strength alloy having enhanced mechanical properties, tensile strength being greater than 63,000 psi which comprises:

subjecting a Zn Al/Cu/Mg alloy containing from about 20 to 28 weight percent aluminum, from about 0.1 to 3.5 weight percent copper, about 0.01 to 0.5 weight percent magnesium, and the remainder zinc, to a temperature between 550° F., to 750° F., to effect homogenization of said alloy, cooling the homogenized alloy to about 550° F., working the homogenized alloy at a temperature above about 527° F., to attain between about 10 to 75 percent reduction, quenching the worked alloy below about 400° F., at a minimum rate of cooling of at least 180° F., per second, maintaining the temperature of the alloy at between about 300° F., to about 400° F., for a period of at least 10 minutes to effect a transformation to the alpha, aluminum rich plus beta, zinc rich two-phase alloy, and cooling the transformed alloy to about ambient temperature.

10. A method in accordance with claim 9 wherein the temperature of homogenization is 650° F. ± 20° F.

11. A method in accordance with claim 9 wherein the quenching of the alloy is to a temperature of about 350°F.

12. A method in accordance with claim 9 wherein the quenching of the alloy is to a temperature of about 300°F.

13. A method in accordance with claim 9 wherein the quench temperature is held between about 10 to about 15 minutes prior to cooling to ambient temperature.

14. A method in accordance with claim 9 wherein the quench rate is at least about 200° F., per second.

15. A stable, metallurgical composition comprising about 20 to 28 weight percent aluminum, about 0.1 to about 3.5 weight percent copper, about 0.01 to 0.5 weight percent magnesium and the remainder zinc, the composition having a fine grained lamellar microstructure consisting of an alpha-phase of aluminum rich material and a beta-phase zinc rich material, said composition having an ultimate tensile strength in excess of 50,000 psi, an elongation between about 10 and 30 percent and a hardness of between about 50 and 80.

* * * * *